US007860410B2

(12) United States Patent
Tachiki et al.

(10) Patent No.: US 7,860,410 B2
(45) Date of Patent: Dec. 28, 2010

(54) TRANSFER DEVICE INCLUDING DETECTING MECHANISM FOR DETECTING REPLACEMENT BELT UNIT AND IMAGE FORMING APPARATUS USING THE SAME

(75) Inventors: Hiroshi Tachiki, Nara (JP); Tomohiko Fujii, Kizugawa (JP); Kohichi Yamauchi, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 25 days.

(21) Appl. No.: 12/405,281

(22) Filed: Mar. 17, 2009

(65) Prior Publication Data

US 2009/0252517 A1 Oct. 8, 2009

(30) Foreign Application Priority Data

Apr. 2, 2008 (JP) ..... 2008-095940

(51) Int. Cl.
*G03G 15/00* (2006.01)

(52) U.S. Cl. ..... 399/12; 399/24; 399/302

(58) Field of Classification Search ..... 399/8, 399/12, 13, 66, 302, 308, 317
See application file for complete search history.

(56) References Cited

FOREIGN PATENT DOCUMENTS

| | | |
|---|---|---|
| JP | 05-204195 | 8/1993 |
| JP | 2006-276562 | 10/2006 |

*Primary Examiner*—Hoang Ngo
(74) *Attorney, Agent, or Firm*—Renner, Otto, Boisselle & Sklar, LLP

(57) ABSTRACT

As a projection extending member is arranged adjacently to a projection, a sensor S1 produces an "ON" state output when an eccentric cam starts turning even in non-printing mode. The time from when the eccentric cam starts turning until sensor S1 changes its output from "ON" to "OFF" becomes longer when a new intermediate transfer belt unit is used than when a used intermediate transfer belt unit is used. The length of this time is measured so as to detect whether the intermediate transfer belt unit is brand-new or old.

8 Claims, 14 Drawing Sheets

The condition when brand-new

The condition when not brand-new (having been used)

The condition when not brand-new
(having been used)

The condition when brand-new

TRANSFER DEVICE INCLUDING DETECTING MECHANISM FOR DETECTING REPLACEMENT BELT UNIT AND IMAGE FORMING APPARATUS USING THE SAME

This Nonprovisional application claims priority under 35 U.S.C. §119(a) on Patent Application No. 2008-095940 filed in Japan on 2 Apr. 2008, the entire contents of which are hereby incorporated by reference.

BACKGROUND OF THE INVENTION (1) Field of the Invention

The present invention relates to a transfer device and an image forming apparatus including this device, in particular, relating to a transfer device including a detecting mechanism for detecting replacement of a new unit.

(2) Description of the Prior Art

An electric appliance such as a color image forming apparatus etc., includes a sensor for detecting a new unit being set, in order to determine the time of replacement of a removable unit. The appliance also includes a sensor for detecting whether the replacement unit is correctly attached inside the appliance.

In the above way, there is the need for providing a plurality of sensors for detecting the information on attachment of a replacement unit, posing the problem of increasing the production cost and reducing reliability.

To deal with the above situation, there is a disclosure (patent document 1: Japanese Patent Application Laid-open Hei 05 No. 204195) of a photoreceptor unit of an image forming apparatus, in which, in order to reduce the number of the sensors as above, a common sensor is used to detect both the presence of the unit and whether the unit is new.

However, a transfer device for a color image forming apparatus, for example, needs many sensors other than the aforementioned sensors, including sensors for determining the operational status such as color mode, monochrome mode, non-printing mode or the like. Therefore, it has been difficult to obtain better results in cutting down the production cost and improving reliability by only integrating the sensor for detecting the presence of a unit with that for detecting whether the unit is new and old into a common configuration.

SUMMARY OF THE INVENTION

The present invention has been devised in view of the above circumstances, it is therefore an object of the present invention to provide a transfer device which is reduced in manufacturing cost and device size and improved in reliability by combining the sensor for detecting the presence of the unit and whether the unit is old or new into further another sensor, as well as to provide an image forming apparatus including this transfer device.

In order to achieve the above object, the transfer device according to the present invention and the image forming apparatus including this device are configured as follows:

A transfer device according to the present invention includes: an intermediate transfer belt unit including an intermediate transfer belt for superposing toner images from a plurality of photoreceptors, one over another and a contacting/separating mechanism for putting the intermediate transfer belt into or out of contact with the plural photoreceptors; and, a detecting portion for performing detection of the contact/separation status between the photoreceptors and the intermediate transfer belt depending on the operational mode, inclusive of non-printing and printing modes and performing detection of the information for distinguishing a new intermediate transfer belt unit when the used intermediate transfer belt unit was replaced with a new unit, and is characterized in that the intermediate transfer belt unit is changed in contact/separation status in accordance with the operational mode, by controlling and driving the contacting/separating mechanism.

The transfer device according to the present invention is characterized in that the intermediate transfer belt unit includes a detection piece which makes the detecting portion detect the contact/separation status while the detecting portion includes a sensor portion which, when the intermediate transfer belt unit is replaced by a new unit, detects the presence or absence of the detection piece based on the changing positional relationship between a projection extending member that is located adjacently to the detection piece and the detection piece as the contacting/separating mechanism moves, and the detecting portion, based on the information detected by the sensor portion, gives notice of the contact/separation status between the photoreceptors and the intermediate transfer belt.

The transfer device according to the present invention is characterized in that the detecting portion detects the time of movement of the contacting/separating mechanism from when the contacting/separating mechanism starts to move until the projection extending member is moved in link with the positional change of the detection piece and pushed out by the detection piece, and compares the time of movement with a predetermined threshold time so as to determine whether the intermediate transfer belt unit is brand-new or not.

The transfer device according to the present invention is characterized in that, in order to distinguish operational modes inclusive of the non-printing and printing modes, the sensor portion of the detecting portion includes a first sensor part which detects the presence of the detection piece alone and a second sensor part which also detects the presence of the detection piece when the detection piece operates in link with the projection extending member, and on the condition that the output from the first sensor part and the output from the second sensor part exist in a particular output status, the detecting portion determines that the intermediate transfer belt is one that has been already used when the output from the first sensor part changes earlier than the output from the second sensor part, and that the intermediate transfer belt is a new one when the output from the second sensor part changes earlier than the output from the first sensor part, after the contacting/separating mechanism starts moving.

The transfer device according to the present invention is characterized in that when no detection piece is detected by the sensor portion and hence the contact/separation status of the intermediate transfer belt cannot be identified, the detecting portion determines that no intermediate transfer belt unit is mounted.

Also, the transfer device according to the present invention is characterized in that the projection extending member of the detecting portion includes: a shading piece for blocking light; a support for rotatably supporting the shading part; and a weight disposed at the end where the shading piece is supported by the support, and is configured so that when the shading piece has rotated by a predetermined angle, the projection extending member is fixed at the predetermined positional angle by the force of gravity acting on the weight.

Further, the transfer device according to the present invention is characterized in that the intermediate transfer belt unit drives and controls the contacting/separating mechanism during the start sequence including power activation so as to set the contact/separation status between the intermediate transfer belt and the plural photoreceptors into the initial state.

Moreover, the transfer device according to the present invention is characterized in that the detecting portion distinguishes three modes of color mode, monochrome mode and non-printing mode, as the operational modes associated with the contact/separation status between the intermediate transfer belt and the photoreceptors.

According to the transfer device of the present invention and the image forming apparatus including this device, excellent effect as follows can be obtained.

According to the present invention, whether the intermediate transfer belt unit is new or used and mounted or unmounted is determined based on the sensors that detect the contact/separation status of the intermediate transfer belt to the photoreceptors, hence it is possible to reduce the number of parts for the detecting mechanism, hence make the apparatus compact.

DESCRIPTION OF THE PREFERRED EMBODIMENTS

Figure 1:
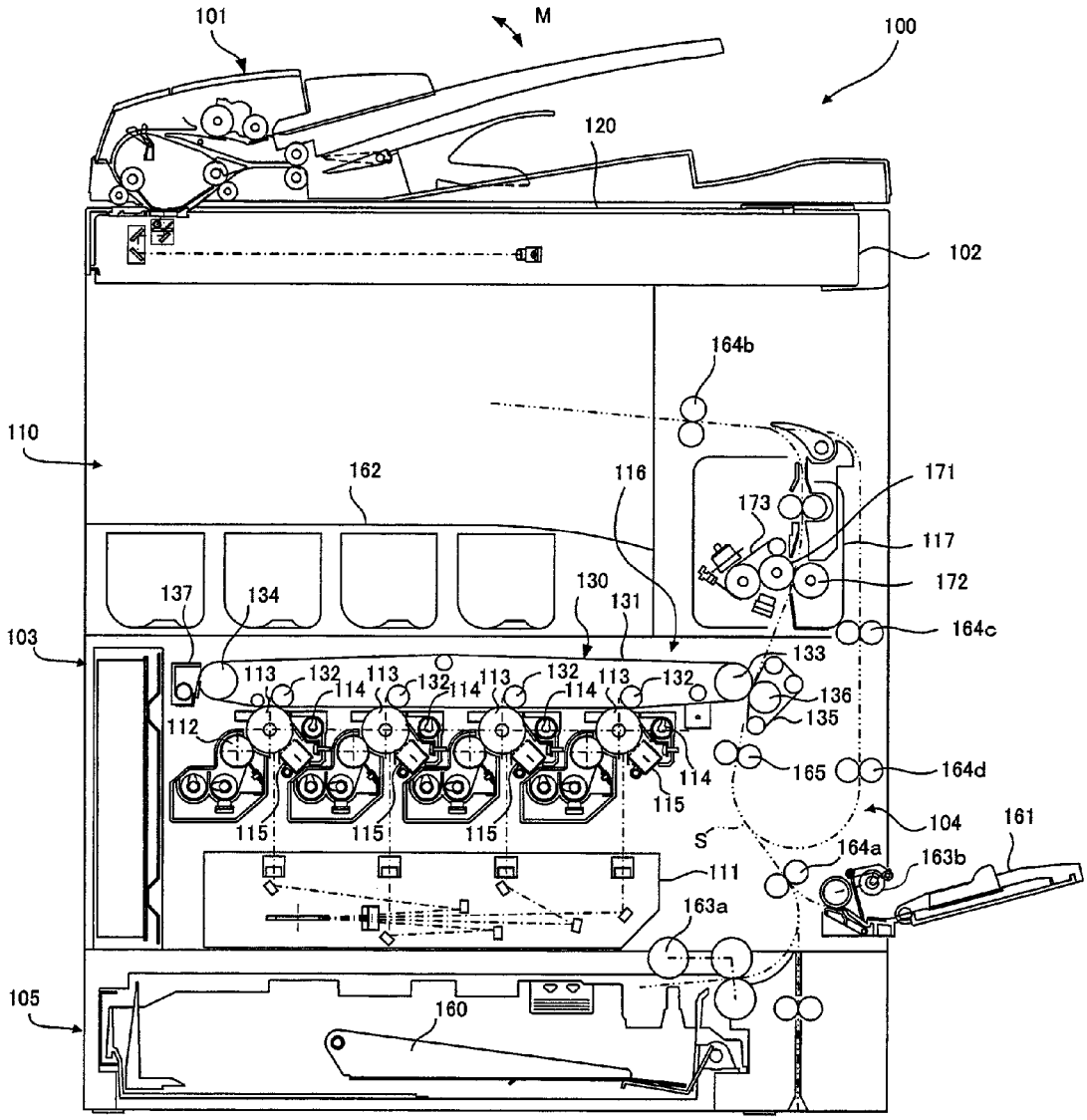
FIG. 1 is a diagram showing a configurational example of an image forming apparatus including a transfer device according to the present invention.

The best embodied mode of a transfer device of the present invention and an image forming apparatus including this will hereinafter be described with reference to the accompanying drawings.

FIGS. 1 to 14 are views showing one example of the embodiment of a transfer device according to the present invention and an image forming apparatus including this. In the drawings, the components allotted with the same reference numerals will represent identical components.

<Description on the Overall Configuration and Operation of an Image Forming Apparatus of the Present Invention>

To begin with, the overall configuration and operation of the image forming apparatus will be briefly described before giving description on the specific configuration and operation of the transfer device according to the present invention.

FIG. 1 is a diagram showing a configurational example of an image forming apparatus including a transfer device according to the present invention.

An image forming apparatus 100 forms a multi-colored or monochrome image on predetermined recording paper (which will be referred to hereinbelow as a sheet) in accordance with image data input from without, and is essentially composed of an automatic document processor (ADF) 101, an image reader 102, an image forming portion 103, a sheet feed portion 104 and a paper feed unit 105.

Particularly, among the above constituents, image forming portion 103 is to record an original image represented by image data on a sheet and includes an exposure unit 111, developing units 112, photoreceptor drums 113, cleaner units 114, chargers 115, a transfer device 116 according to the present invention, a fusing unit 117 and the like.

Arranged on top of image reader 102 is a document table 120 made of a transparent glass plate on which a document is placed. On the top of document table 120, an automatic document processor 101 for automatically feeding documents is mounted. This automatic document processor 101 is constructed so as to be pivotable along the bidirectional arrow M so that a document can be manually placed by opening the top of document table 120.

The image data handled in image forming portion 103 of the image forming apparatus 100 is data for color images of four colors, i.e., black (K), cyan (C), magenta (M) and yellow (Y). Accordingly, four developing units 112, four photoreceptor drums 113, four chargers 115, four cleaner units 114 are provided to produce four kinds of latent images corresponding to black, cyan, magenta and yellow. That is, four imaging stations are constructed thereby.

Charger 115 is the charging means for uniformly electrifying the photoreceptor drum 113 surface at a predetermined potential. Other than the illustrated corona-discharge type chargers, chargers of a contact roller type or a brush type may also be used.

Exposure unit 111 as the image writer is constructed as a laser scanning unit (LSU) having a laser emitter, reflection mirrors, etc. In this exposure unit 111, a polygon mirror for scanning a laser beam, optical elements such as lenses and mirrors for leading the laser beam reflected off the polygon mirror to photoreceptor drums 113 are laid out. This exposure unit 111 illuminates each of the electrified photoreceptor drums 113 with light in accordance with the input image data to form an electrostatic latent image corresponding to the image data on each photoreceptor drum surface.

Developing units 112 visualize the electrostatic latent images formed on photoreceptor drums 113 with four color (KCMY) toners. Cleaner unit 114 removes and collects the toner left over on the photoreceptor drum 113 surface after development and image transfer.

As shown in FIG. 1, a transfer device 116 according to the present invention is comprised of: an intermediate transfer belt unit 130 which is a removable replacement unit, arranged over photoreceptor drums 113 and including an intermediate transfer belt 131, four intermediate transfer rollers 132 corresponding to KCMY colors, an intermediate transfer belt drive roller 133, an intermediate transfer belt driven roller 134; a transfer belt 135; a transfer roller 136; an intermediate transfer belt cleaning unit 137; and the like.

Intermediate transfer rollers 132, intermediate transfer belt drive roller 133 and intermediate transfer belt driven roller 134 support and tension intermediate transfer belt 131 to circulatively drive the belt. Each intermediate transfer roller 132 provides a transfer bias for transferring the toner image from photoreceptor drum 113 onto intermediate transfer belt 131.

Intermediate transfer belt 131 is arranged so as to contact with every photoreceptor drum 113. The toner images of different colors formed on photoreceptor drums 113 are sequentially transferred in layers to intermediate transfer belt 131, forming a color toner image (multi-color toner image) on intermediate transfer belt 131. This intermediate transfer belt 131 is an endless film of about 100 μm to 150 μm thick, for example.

Transfer of toner images from photoreceptor drums 113 to intermediate transfer belt 131 are performed by intermediate transfer rollers 132 that are in contact with the rear side of intermediate transfer belt 131. Each intermediate transfer roller 132 has a high-voltage transfer bias (high voltage of a polarity (+) opposite to the polarity (−) of the static charge on the toner) applied thereto in order to transfer the toner image. This intermediate transfer roller 132 is a roller that is formed of a base shaft made of metal (e.g., stainless steel) having a diameter of 8 to 10 mm and a conductive elastic material (e.g., EPDM, foamed urethane or the like) coated on the shaft surface. This conductive elastic material enables uniform application of a high voltage to intermediate transfer roller 132. Though in the present embodiment, rollers are used as the transfer electrodes, brushes or the like can also be used instead.

As stated above, the visualized electrostatic images of different colors on different photoreceptor drums 113 are laid over one after another on intermediate transfer belt 131. The thus laminated image information is conveyed by the circulation of intermediate transfer belt 131 to the secondary transfer position opposing transfer roller 136 while a sheet is fed from an aftermentioned paper feed cassette 160 or manual paper feed tray 161 and conveyed through and between secondary transfer belt 135 and intermediate transfer belt 131. At this time, transfer roller 136 is impressed with a high voltage of the polarity opposite to that of the static charge on the toner. As a result, the toner image is transferred from the outer peripheral surface of intermediate transfer belt 131 to the sheet surface.

In this process, intermediate transfer belt drive roller 133 and secondary transfer roller 136 are put in press-contact with each other forming a predetermined nip while a voltage for transferring the toner to the sheet (a high voltage of a polarity (+) opposite to the polarity (−) of the static charge on the toner) is applied to transfer roller 136. Further, in order to constantly obtain the aforementioned nip, either transfer roller 136 or intermediate transfer belt drive roller 133 is formed of a hard material (metal or the like) while the other is formed of a soft material such as an elastic roller or the like (elastic rubber roller, foamed resin roller etc.).

Since the toner adhering to intermediate transfer belt 131 as the belt comes into contact with photoreceptor drums 113, or the toner which has not been transferred by transfer roller 136 from intermediate transfer belt 131 to the sheet and remains thereon, would cause color contamination of toners at the next operation, the remaining toner is adapted to be removed and collected by intermediate transfer belt cleaning unit 137, as stated above.

This intermediate transfer belt cleaning unit 137 includes, for example a cleaning blade as a cleaning member that comes in contact with intermediate transfer belt 131. Intermediate transfer belt 131 is supported from its interior side by intermediate transfer belt driven roller 134, at the portion where this cleaning blade comes into contact with the belt.

Arranged in paper feed unit 105 of image forming apparatus 100 under exposure unit 111 is a paper feed cassette 160 as a tray for stacking sheets to be used for image forming. There is also a manual paper feed cassette 161, on which sheets for image forming can be set.

A paper output tray 162 arranged in the upper part of image forming portion 103 is a tray on which the printed sheets are collected facedown.

The sheet conveyor arrangement, designated at 104, includes a sheet feed path S that extends approximately vertically to convey the sheet from paper feed cassette 160 or manual paper feed cassette 161 to paper output tray 162 by way of fusing unit 117 etc. Arranged along sheet feed path S from paper feed cassette 160 or manual paper feed cassette 161 to paper output tray 162 are pickup rollers 163*a* and 163*b*, a plurality of feed rollers 164*a* to 164*d*, a registration roller 165, fusing unit 117 and the like.

Feed rollers 164*a* to 164*d* are a plurality of small rollers for promoting and supporting conveyance of sheets and are arranged at different positions along sheet feed path S. Pickup roller 163*a* is arranged near the end of paper feed cassette 160 so as to pick up one sheet at a time from paper feed cassette 160 and deliver it to sheet feed path S. Similarly, pickup roller 163*b* is arranged near the end of manual paper feed cassette 161 so as to pick up one sheet at a time from manual paper feed cassette 161 and deliver it to sheet feed path S.

Registration roller 165 temporarily suspends the sheet that is conveyed along sheet feed path S. This roller delivers the sheet toward transfer roller 136 at such a timing that the front end of the sheet will meet the front end of the toner image formed on intermediate transfer belt 131.

Fusing unit 117 includes a heat roller 171 and a pressing roller 172. Heat roller 171 and pressing roller 172 are arranged so as to rotate while nipping the sheet. This heater roller 171 is set at a predetermined fusing temperature by a drive controller (not shown) in accordance with the signal from an unillustrated temperature detector, and has the function of heating and pressing the toner to the sheet in cooperation with pressing roller 172, so as to thermally fix the toner image transferred on the sheet to the sheet by fusing, mixing and pressing the color image of multiple toners. The fusing unit further includes an external heating belt 173 for heating heat roller 171 from without.

The sheet passes through fuser unit 117, whereby the unfixed toner on the sheet is fused by heat and fixed. Then the sheet is discharged through feed rollers 164*b* arranged downstream, onto paper output tray 162.

The sheet feed path described above is that of the sheet for a one-sided printing request. In contrast, when a duplex printing request is given, the sheet with its one side printed passes through fusing unit 117 and is held at its rear end by the final feed roller 164*b*, then the feed roller 164*b* is rotated in reverse so as to lead the sheet toward feed rollers 164*c* and 164*d*. Thereafter, the sheet passes through registration roller 165 and is printed on its rear side and discharged onto paper output tray 162.

Next, the configuration and specific operation of the intermediate transfer belt unit that characterizes transfer unit 116 according to the present invention provided for image forming apparatus 100 described above will be described herein below.

Figure 2:
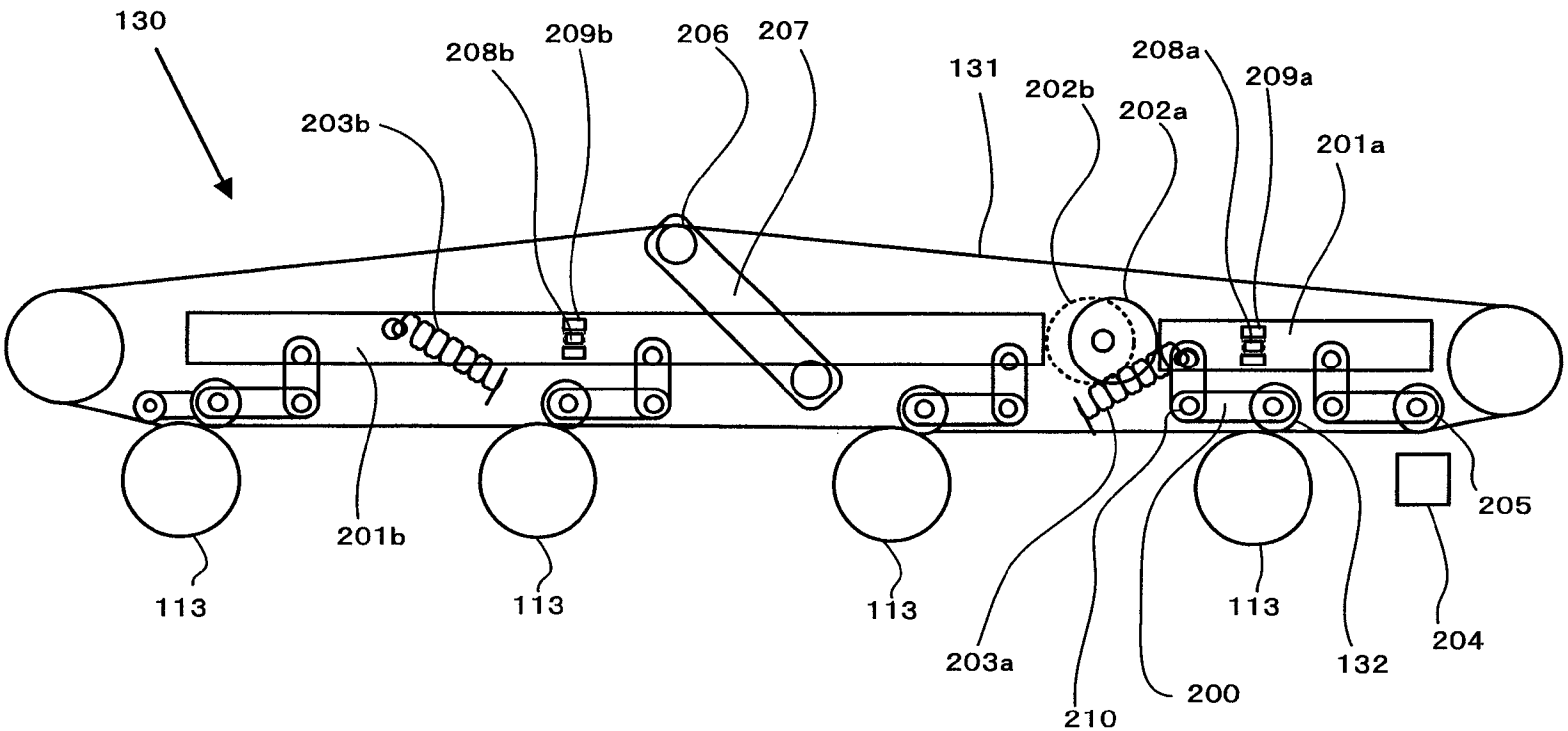
FIG. 2 is an enlarged diagram showing a configuration of an intermediate transfer belt unit.

FIG. 2 is an enlarged diagram showing the configuration of the intermediate transfer belt unit.

As shown in FIG. 2, intermediate transfer belt unit 130 includes the following constituents in addition to those shown in FIG. 1.

That is, the intermediate transfer belt unit further includes: a plurality of transfer roller arms 200 which each rotatably support intermediate transfer roller 132; sliders 201*a* and 201*b* which slide in the left-and-light direction so as to put intermediate transfer belt 131 into press-contact with, or separate the belt from, photoreceptor drums 113; an eccentric cam 202*a* that comes into contact with slider 201*a* alone to shift slider 201*a* left and right; and an eccentric cam 202*b* that comes into contact with slider 201*b* alone to shift slider 201*b* left and right; springs 203*a* and 203*b* pressing sliders 201*a* and 201*b* against eccentric cams 202*a* and 202*b* by elastic force; a density sensor 204 for detecting the reflected light from a test toner pattern; a backup roller 205 positioned in front of density sensor 203 for making intermediate transfer belt 131 flat so that density sensor 203 can exactly detect the reflected light; a tension roller arm 207 which is supported by a tension roller 206 and provides a predetermined tensile force to intermediate transfer belt 131; detection pieces 208*a* and 208*b* (which will be referred to hereinbelow as projections) provided for sliders 201*a* and 201*b* so as to block or permit transmission of light from the light emitters of aftermentioned photosensor parts 209*a* and 209*b*; and photosensor parts (detecting portion) 209*a* and 209*b* that detect the positions of these two projections 208*a* and 208*b* so as to detect the contact/separation status between intermediate transfer belt 131 and photoreceptor drums 113.

Here, as illustrated, intermediate transfer roller arm 200 is constructed so as to be rotatable on a rotary pivot 210 while eccentric cams 202*a* and 202*b* are attached to a common rotational shaft and driven on the same shaft by an unillustrated drive source. This set of constituents including the aforementioned sliders 201*a* and 201*b*, eccentric cams 202*a* and 202*b*, springs 203*a* and 203*b* and detection pieces 208*a* and 208*b* forms a "contacting/separating mechanism".

Now, the arrangement of photosensor parts (detecting portion) 209*a* and 209*b* for detecting the contact/separation status between intermediate transfer belt 131 and photoreceptor drums 113 and the photosensor output will be briefly described.

Figure 3B:
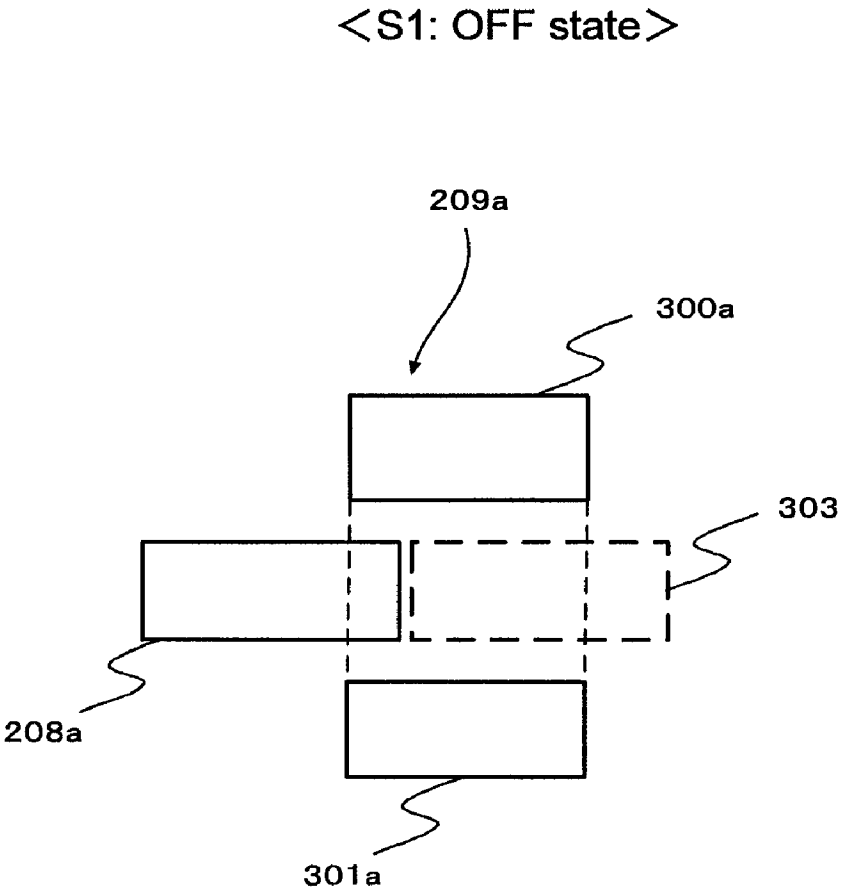
FIGS. 3A and 3B are diagrams showing the output of a photosensor based on the positional relationship between the photosensor and a projection.
Figure 3A:
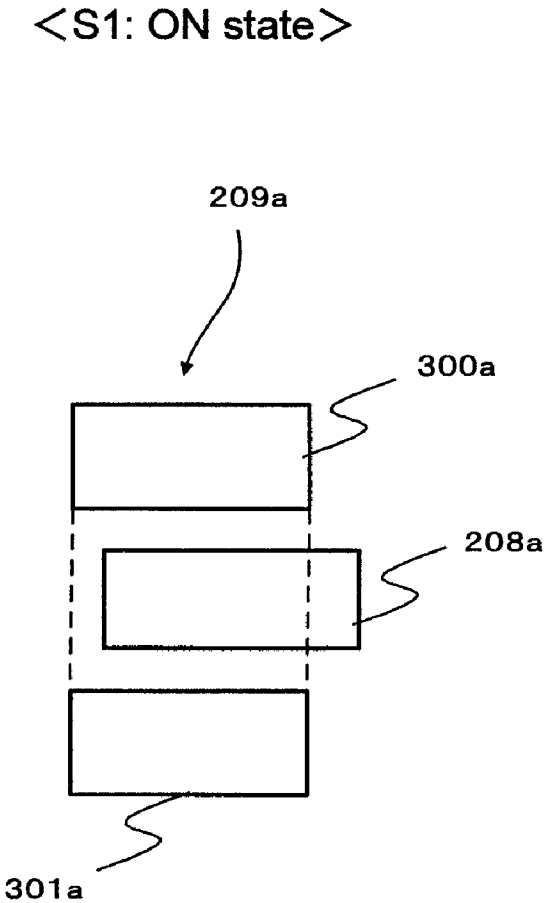

FIGS. 3A and 3B are diagrams for illustrating the photosensor output based on the positional relationship between the photosensor and the projection.

In photosensor part 209*a* (which will be referred to hereinbelow as sensor S1) and photosensor part 209*b* (which will be referred to hereinbelow as sensor S2), a transmitter (which will be assumed to be a LED) 300*a* or 300*b* and a receiver (which will be assumed to be a phototransistor) 301*a* or 301*b* are arranged opposing each other. The following description, inclusive of FIG. 8 below, will be described referring to sensor S1, but sensor S2 also operates in a similar manner. When projection 208*a* provided in slider 201*a* moves into and between LED 300*a* and phototransistor 301*a* so as to block light emitted from LED 300*a*, the inverted output from phototransistor 301*a* by way of an inverter 302*a* will take the "L" level (will be defined as "ON") as shown in FIG. 3A. On the other hand, when projection 208*a* resides almost out of the range between LED 300*a* and phototransistor 301*a*, the inverted output from phototransistor 301*a* by way of inverter 302*a* will take the "H" level (will be defined as "OFF").

As will be described later, from the movement of sliders 201*a* and 201*b*, sensors S1 and S2 can distinguish three operational modes. Further, when intermediate transfer belt unit 130 is not attached, no projections 208*a* and 208*b* exist at all, both sensors S1 and S2 output the "OFF" state, thus it is possible to determine "presence or absence" of intermediate transfer belt unit 130.

Further, in FIG. 3B, though projection 208*a* is almost out of the position in which sensor S1 is "ON", a projection extending member 303, depicted by the broken line, for substantially turning the output from sensor S1 "ON", is added. This projection extending member 303 is a part to be used to detect whether a new intermediate transfer belt unit 130 is set. This configuration and detailed operation will be described later.

Figure 4A:
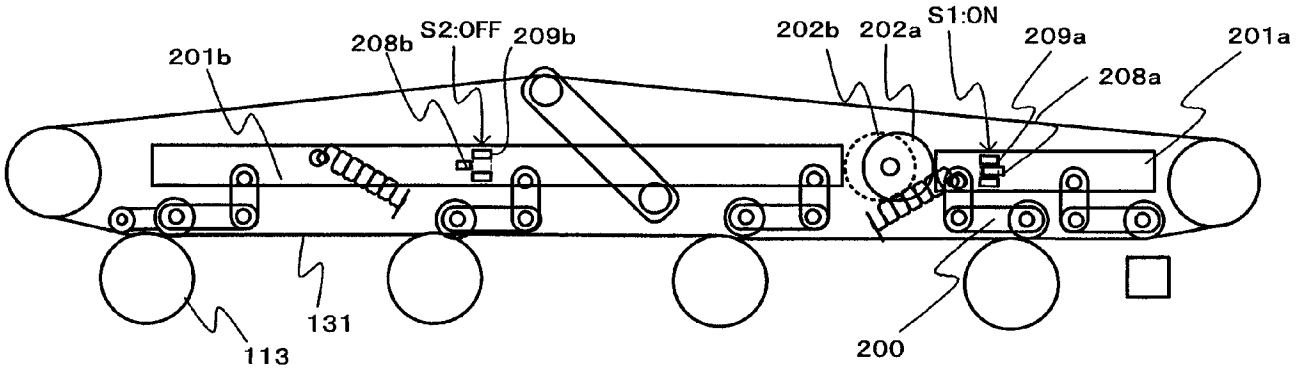
FIGS. 4A to 4C are diagrams showing the states in different operational modes of a transfer belt unit, FIGS. 4A, 4B and 4C showing the states in color mode, monochrome mode and non-printing mode, respectively.
Figure 4B:
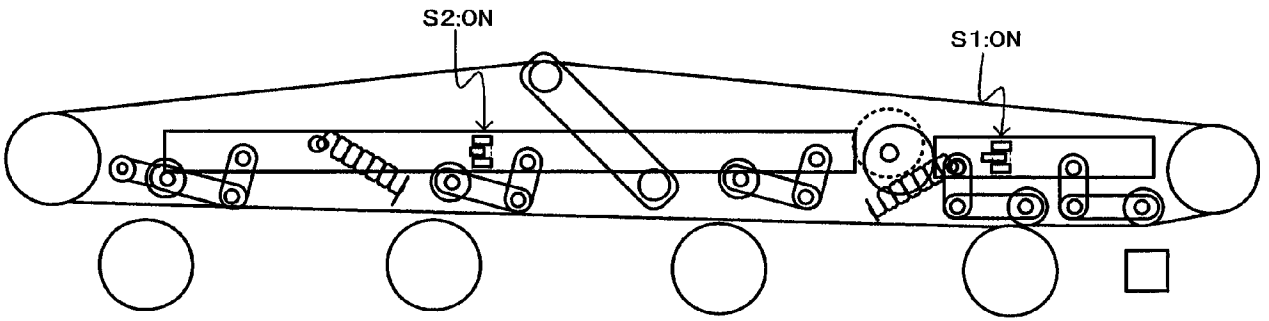
Figure 4C:
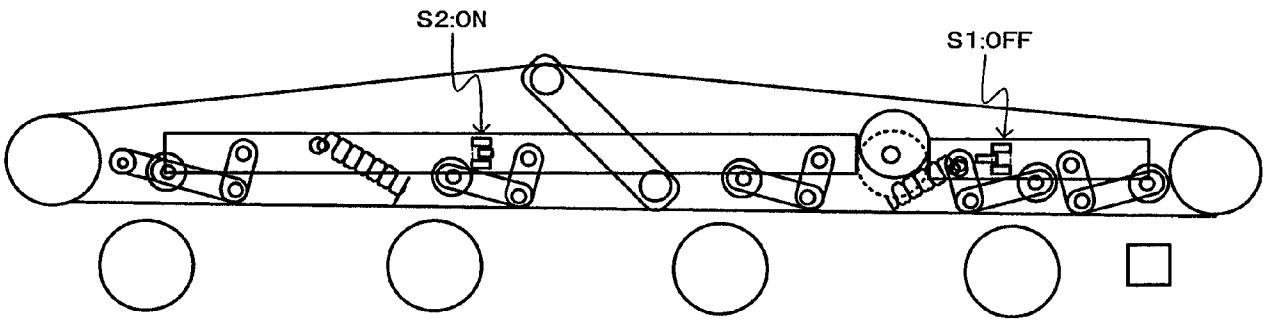

FIGS. 4A to 4C are diagrams showing the states of three operational modes of the transfer belt unit. FIG. 4A is a diagram showing the state in color mode, FIG. 4B is a diagram showing the state in monochrome mode, and FIG. 4C is a diagram showing the state in non-printing mode.

Here, FIGS. 4A to 4C and FIGS. 5A to 5C below are not to illustrate replacement of a new intermediate transfer belt unit 130 but are diagrams for illustrating the operational mode of the transfer belt unit when the aforementioned projection extending member 303 is not attached on the extension of projection 208*a*. Also, the state in non-printing mode should be defined as the case when the major axis of eccentric cam 202*a* is positioned perpendicularly to sliders 201*a* and 201*b* and is directed upwards on the document.

As shown in FIGS. 4A to 4C, as eccentric cams 202*a* and 202*b* turn, transfer belt unit 130 changes the contact/separation status between intermediate transfer belt unit 130 and photoreceptor drums 113, depending on the rotatory phase (the angle of the major axis of each eccentric cam) of eccentric cams 202*a* and 202*b* to thereby produce three different states, namely, color mode (FIG. 4A), monochrome mode (FIG. 4B) and non-printing mode (FIG. 4C).

In color mode (FIG. 4A), eccentric cams 202*a* and 202*b* are set with their major axes positioned perfectly parallel to sliders 201*a* and 201*b*. In this position, projection 208*a* shades photosensor part 209*a* so that sensor S1 is "ON". On the other hand, projection 208*b* comes off photosensor part 209*b* so that sensor S2 is "OFF".

In monochrome mode (FIG. 4B), sensor S1 is "ON", and sensor S2 is "ON". In non-printing mode (FIG. 4C), sensor S1 is "OFF" and sensor S2 is "ON".

Figure 5A:
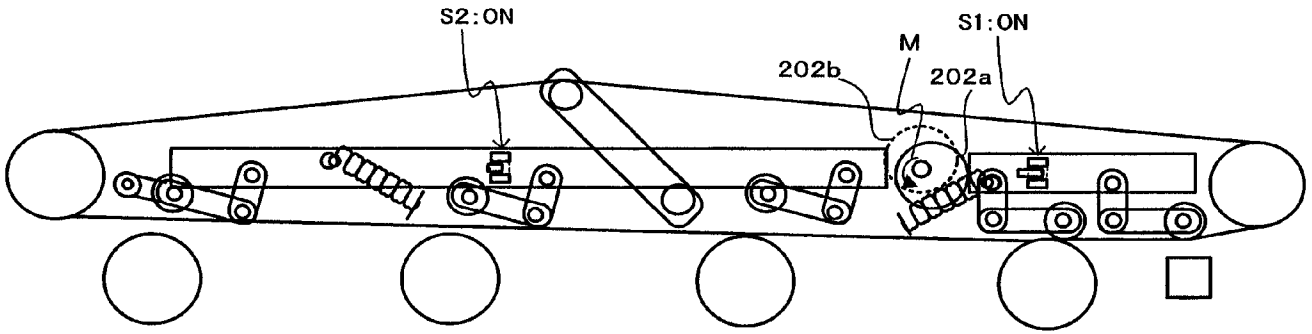
FIGS. 5A to 5C are illustrative diagrams showing operational mode transitions of an intermediate transfer belt unit in accordance with the rotational phases of an eccentric cam, FIGS. 5A, 5B and 5C being diagrams showing the transitions into monochrome mode, color mode and non-printing mode, respectively.
Figure 5B:
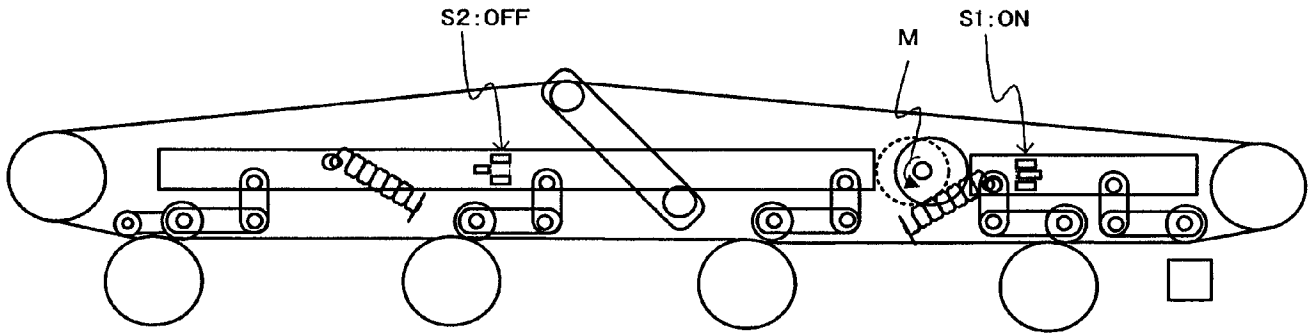
Figure 5C:
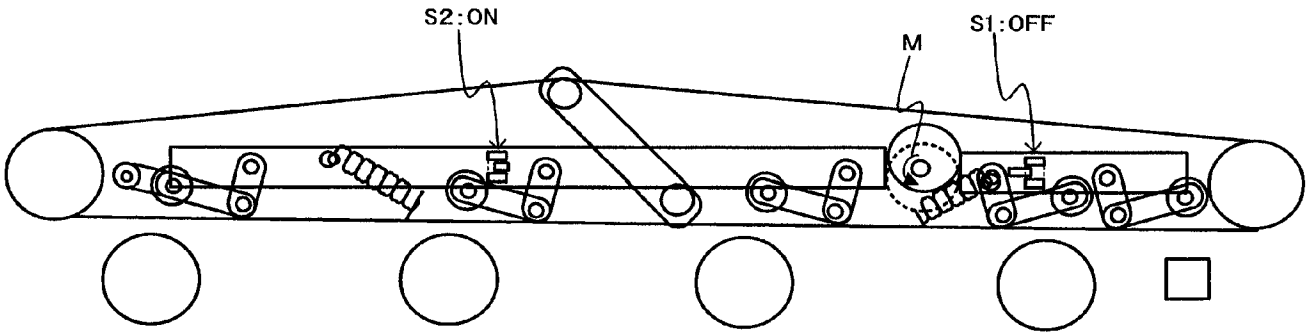

FIGS. 5A to 5C are illustrative diagrams showing operational mode sifts of the intermediate transfer belt unit, depending on the rotary phases of the eccentric cams.

FIG. 5A shows the state (monochrome mode) where sensor S1 is "ON" and sensor S2 is "ON" when eccentric cams 202*a* and 202*b* of the intermediate transfer belt unit start rotating. As eccentric cams 202*a* and 202*b* turn in the direction of arrow M (the counterclockwise direction), the intermediate transfer belt unit transitions to the color mode shown in FIG. 5B. At this time, sensor S1 is "ON" and sensor S2 is "OFF". A further rotation of eccentric cams 202*a* and 202*b* in the direction of arrow M causes the intermediate transfer belt unit to shift to the non-printing mode (FIG. 5C).

Referring next to FIGS. 6A, 6B and 7A to 7D, the operational transition from when a brand-new intermediate transfer belt unit is attached and the apparatus is activated up to the initial state of operation (non-printing mode) and the operation of detecting a brand-new intermediate transfer belt unit having been attached, will be outlined.

Figure 6B:
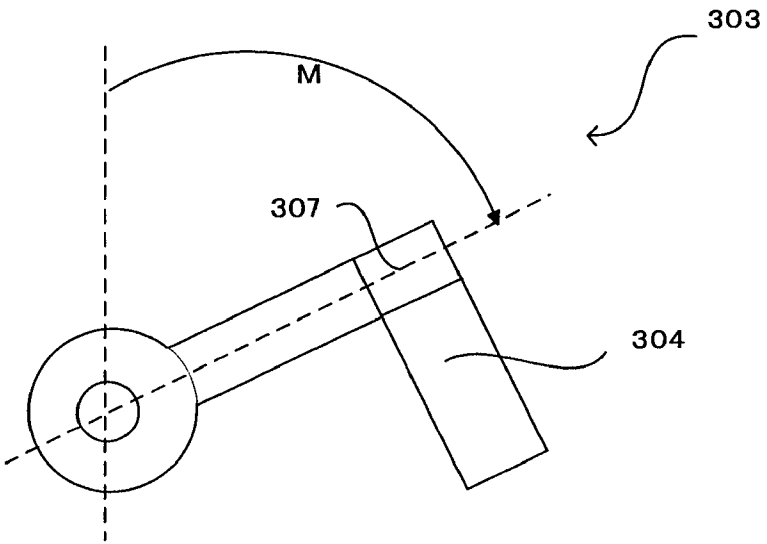
FIGS. 6A and 6B show the configuration of a projection extending member, and are illustrative diagrams showing the projection extending member when a brand-new unit is attached and after detection of attachment of the unit, respectively.
Figure 6A:
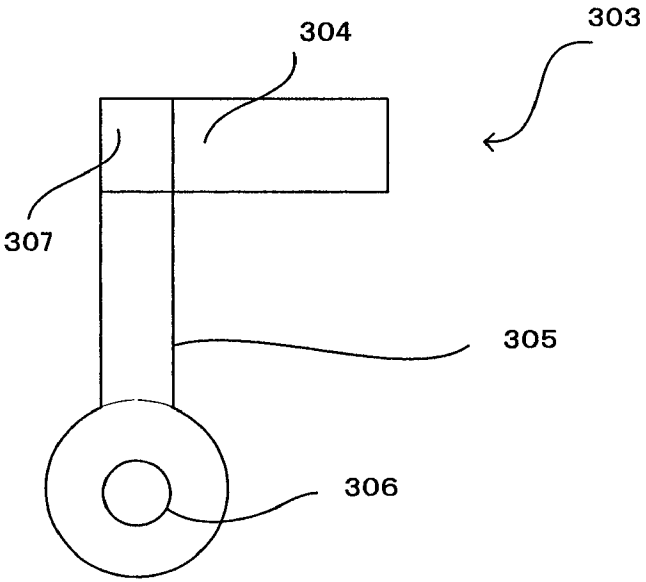

FIGS. 6A and 6B are illustrative diagrams showing the configuration of the projection extending member and its states when a brand-new unit is attached and after detection of its attachment, respectively. FIGS. 7A to 7D are diagrams for illustrating the state transition from when a brand-new intermediate transfer belt unit is attached, up to the initial state of operation.

Figure 7A:
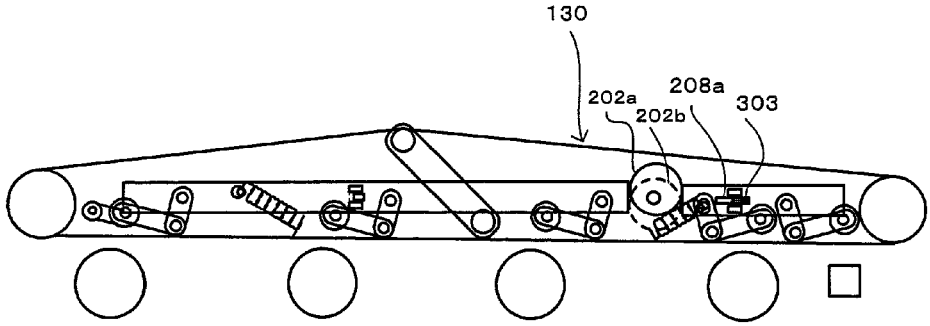
FIGS. 7A to 7D are diagrams for illustrating evolution of the status transition from when a brand-new intermediate transfer belt unit is attached (FIG. 7A) to the initial state of operation (FIG. 7D)

As shown in FIG. 6A, projection extending member 303 is formed of a shading piece 304 for blocking light emitted from sensor S1 and a support 305 that is attached to intermediate transfer belt unit 130 and rotatably supports this shading piece 304 on a pivot axis 306. In this arrangement, when a brand-new unit is mounted, shading piece 304 is located and occupies the space inside sensor S1 and will move being pushed out by projection 208*a* as shown in FIGS. 3A, 3B and 7A. After having been pushed out from sensor S1, the projection extending member 303 rotates by a rotational angle M as shown in FIG. 6B, and will be kept at this position until another brand-new intermediate transfer belt unit 130 is attached next.

In order to maintain this state, projection extending member 303 may have a weight 307 attached at the end of support 305 for support and rotation where shading piece 304 is attached, so that the projection extending member will never return to the position for the unused state due to external vibration and the like after it has once turned by the predetermined angle from the position for the unused state (FIG. 6A) to the position for the used state (FIG. 6B).

Figure 7B:
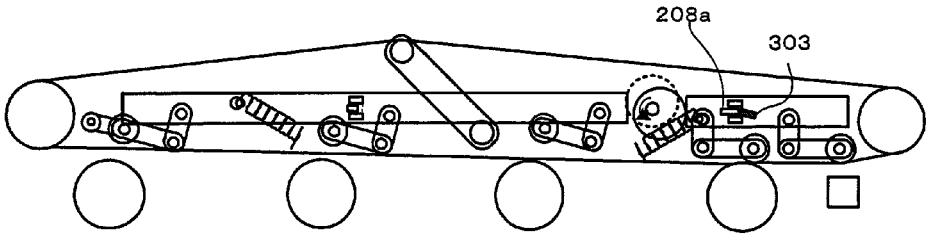
Figure 7C:
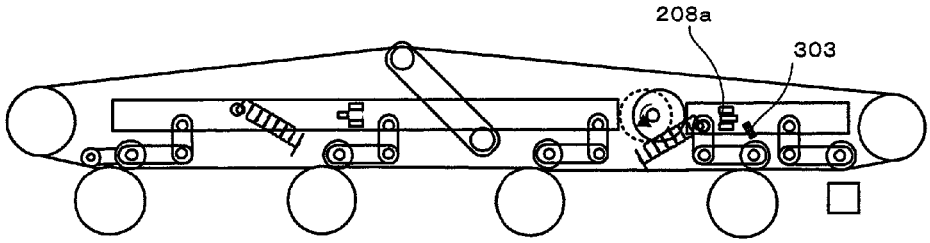
Figure 7D:
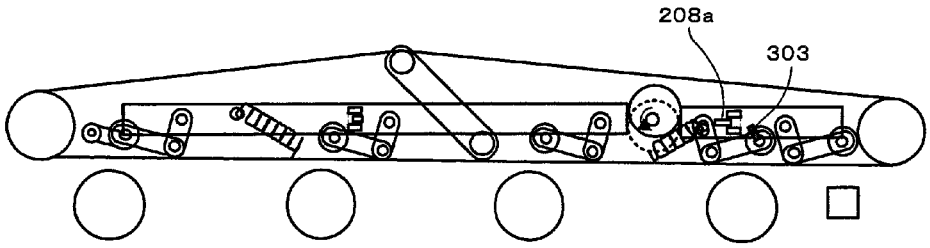

The transitional action from when a brand-new intermediate transfer belt unit is attached and the power is activated to the initial state of operation (non-printing mode) is performed as follows. That is, when first, brand-new intermediate transfer belt unit 130 is attached in the state corresponding to non-printing mode (FIG. 7A), projection extending member 303 and projection 208*a* are located at the position occupying the space inside S1, as stated above. In this condition, S1 is "ON" and S2 is "ON". From this condition, as eccentric cams 202*a* and 202*b* rotate, projection 208*a* moves pushing out projection extending member 303 rightwards in the drawing (FIGS. 7B and 7C). Eccentric cams 202*a* and 202*b* further rotate, and sensor S1 changes from the "ON" state to the "OFF" state (FIG. 7D). Thus, the cams stop and the initial state of operation is established.

In the above way, since projection extending member 303 is arranged at the side of projection 208*a*, sensor S1 outputs the "ON" state when the eccentric cams start rotating even when the apparatus is in non-printing mode. Since the time taken from when the eccentric cams start rotating to the time when the output from sensor S1 changes from "ON" to "OFF", becomes longer than the time taken when the sensor S1 of the used intermediate transfer belt unit changes from "ON" to "OFF" as described later (cf. FIGS. 11 and 12), it is possible to determine whether the intermediate transfer belt unit is new one or old by detecting the length of the above time.

Next, brief description will be made on the electric configuration of a detecting portion 250 for detecting whether intermediate transfer belt unit 130 is attached in place, whether a new one is attached, in addition to detection of the contact/separation status between intermediate transfer belt 131 and photoreceptor drums 113.

Figure 8:
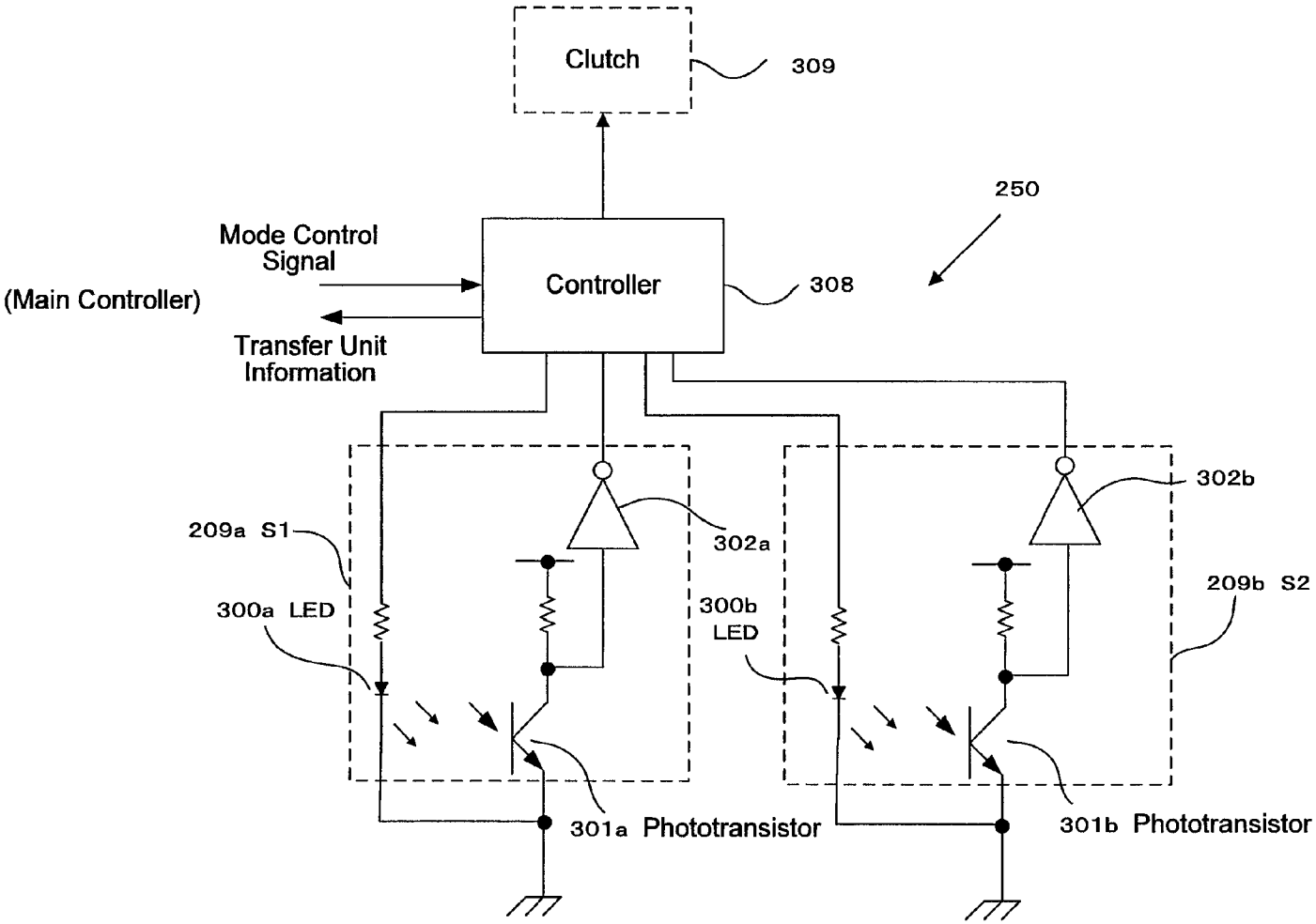
FIG. 8 is a block diagram showing a detecting portion including sensors S1 and S2.

FIG. 8 is a block diagram showing the detecting portion including sensors S1 and S2.

Detecting portion 250 essentially includes a controller 308 which, by performing ON/OFF control of a clutch 309 that transmits drive from an unillustrated driving motor to the eccentric cams in accordance with a mode control signal from an unillustrated main controller, rotates eccentric cams 202*a* and 202*b* to thereby control the contact/separation status between intermediate transfer belt 131 and photoreceptor drums 113; and sensors S1 and S2 for detecting the contact/separation status between intermediate transfer belt 131 and photoreceptor drums 113, and is constructed so as to determine the contact/separation status of the transfer belt, whether the transfer belt unit is new or used and the presence/absence of a transfer belt unit, from the detected result of sensors S1 and S2 and provide the determined result as transfer unit information to the main controller.

Next, the process of determining whether the transfer belt unit is new or used and the presence/absence of a transfer belt unit based on the clutch operation will be described in detail referring to the following exemplary embodiments.

Description on Exemplary Embodiment 1

Figure 9:
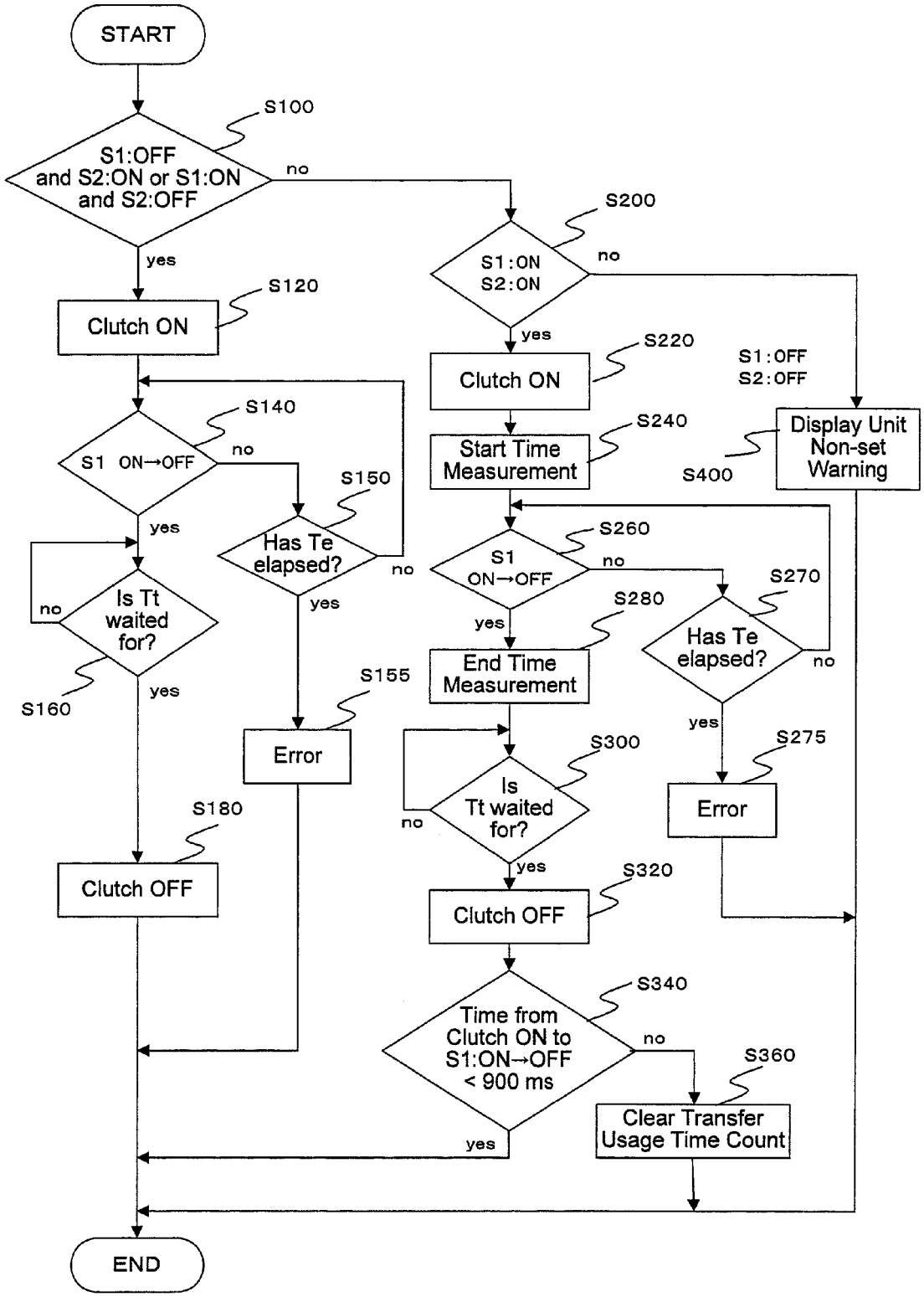
FIG. 9 is a flow chart showing an embodiment 1 of determining whether a transfer belt unit is new or used and the presence of a transfer belt unit.

FIG. 9 is a flow chart showing an exemplary embodiment 1 of the process of determining whether a transfer belt unit is new or used and the presence/absence of a transfer belt unit.

This process is started when, with the power to the main apparatus switched on, the main body door is opened. First, it is checked whether sensors S1 and S2 are "OFF" and "ON" or whether sensors S1 and S2 are "ON" and "OFF" (Step S100). At Step S100, it is determined that the above condition holds (Step S100; yes), clutch 309 is turned on so as to start eccentric cams 202*a* and 202*b* to rotate (Step S120). Then, it is determined whether the output from S1 changes from "ON" to "OFF" (Step S140).

When a change from "ON" to "OFF" is detected (S140; yes), a lapse of time Tt is waited for (Step S160). After lapse of time Tt, clutch 309 is turned "OFF" so as to suspend eccentric cams 202*a* and 202*b* and set intermediate transfer belt unit 130 to the home position (non-printing mode) (Step S180). Thereafter, the operation is waited for until a printing job is commanded.

Before a change from "ON" to "OFF" is detected at Step S140 (Step S140; no), the control is returned to Step S140 to continue the same detection until time Te lapses from when clutch 309 was turned "ON" (Step S150). When no change from "ON" to "OFF" is detected after a lapse of time Te (Step S150; yes), an error indication is given and clutch 309 is turned "OFF" (Step S155).

Next, at Step S100, if the output states of S1 and S2 do not satisfy the designated conditions (Step S100; no), it is checked whether S1 and S2 are both "ON" (Step S200). If both S1 and S2 are determined to be "ON" (Step S200; yes), clutch 309 is turned on, eccentric cams 202*a* and 202*b* are started to rotate (Step S220). Then, measurement of time from when clutch 309 is turned "ON" to when the output from sensor S1 changes from "ON" to "OFF" is started (Step S240).

Further, it is determined whether the output from S1 changes from "ON" to "OFF" (Step S260). When a change from "ON" to "OFF" is detected (S260; yes), the measurement of time is ended (Step S280). Steps S300 and S320 are performed in the same manner as the aforementioned Steps S160 and S180. Then, it is checked whether the measured time from when clutch 309 was turned "ON" to when the output from sensor S1 changed from "ON" to "OFF" is equal to or shorter than a predetermined time T (e.g., 900 ms) (Step S340). If the time is equal to or shorter than predetermined time T (Step S340; yes), it is determined that the intermediate transfer belt unit 130 is a used one, and the current process is ended. Steps S270 and S275 are performed in the same manner as Steps S150 and S155.

On the other hand, when the measured time from when clutch 309 was turned "ON" to when the output from sensor S1 changed from "ON" to "OFF" is determined to be greater than the predetermined time T (Step S340; no), the intermediate transfer belt unit 130 is determined to be brand-new, and the transfer usage time count is cleared and the current process is ended (Step S360).

Here, the transfer usage time count is the cumulative operation time of intermediate transfer belt unit 130, stored by measuring the operation time of intermediate transfer belt unit 130 every time an operation occurs and adding it cumulatively. When this cumulative operation time has become greater than a predetermined value, an indication for recommending replacement of the intermediate transfer belt unit 130 is given by regarding the intermediate transfer belt unit as it reaches its lifespan and the operation of the apparatus is suspended. Then, the transfer usage time count is cleared when the intermediate transfer belt is replaced by a new one.

At Step S200, when sensors S1 and S2 are not determined to be "ON" (Step S200; no), both S1 and S2 are "OFF". Accordingly, it is determined that no intermediate transfer belt unit 130 is set, and the current process is ended after a warning indication is displayed (Step S400).

Figure 10:
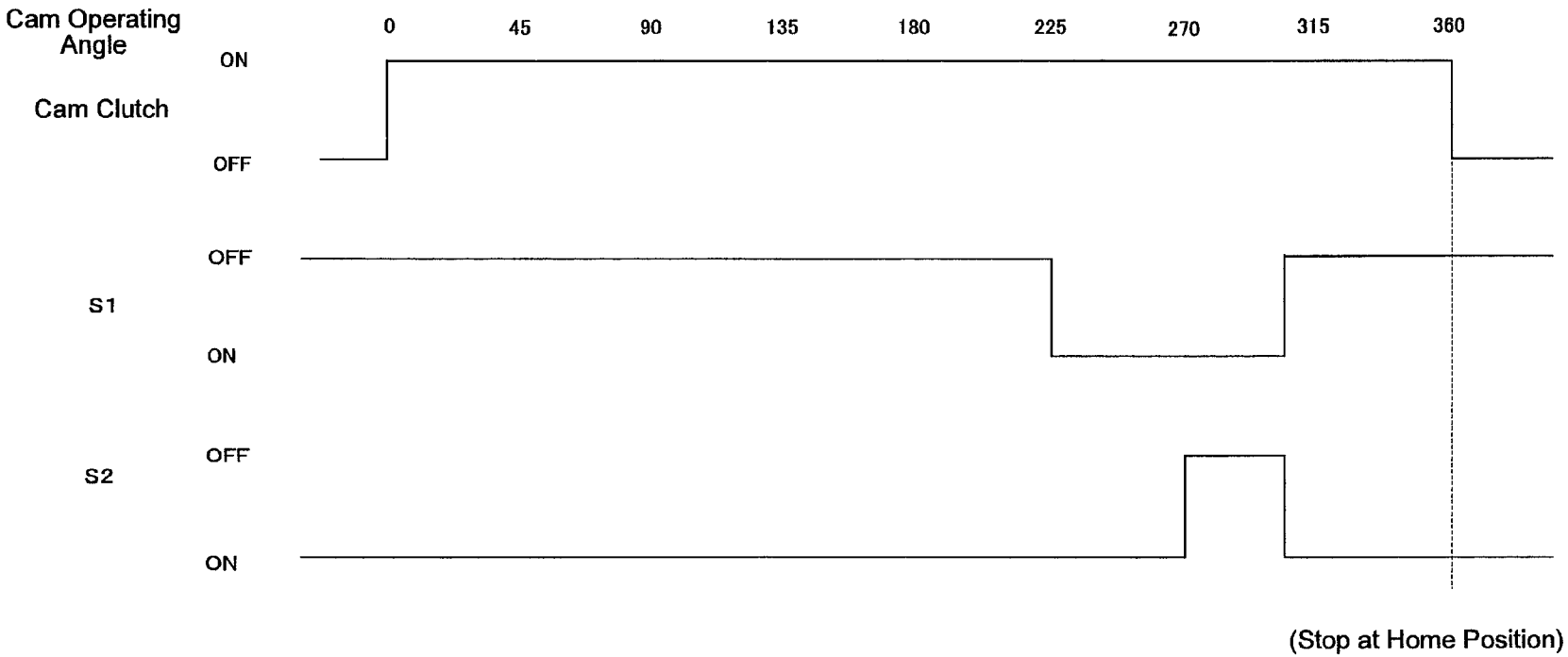
FIG. 10 is a time chart showing the output states of sensors S1 and S2 from when the apparatus is restarted in the normal state or non-printing mode, to the time when the apparatus is initialized at the home position.

Here, FIG. 10 is a time chart showing the evolution of the output states of sensors S1 and S2 from the time clutch 309 is turned "ON", as sensors S1 and S2 change their output, to the time clutch 309 is turned "OFF" at the home position when the apparatus is restarted after the main apparatus being turned off in the normal state, i.e., in non-printing mode.

Figure 11:
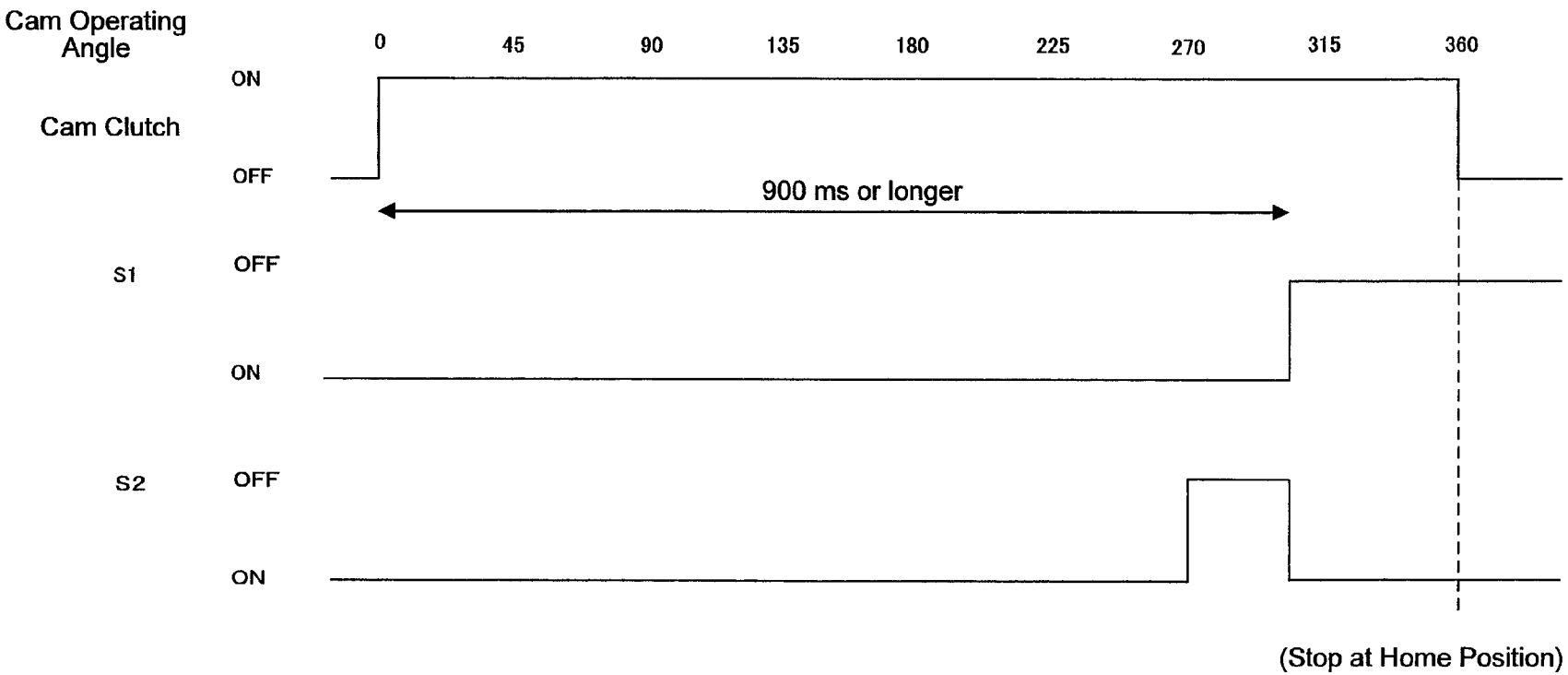
FIG. 11 is a time chart showing the output states of sensors S1 and S2 from when the apparatus is restarted after attachment of a brand-new intermediate transfer belt unit to the time when the apparatus is initialized at the home position.

FIG. 11 is a time chart showing the evolution of the output states of sensors S1 and S2 from when the apparatus door is closed or the apparatus is restarted after attachment of a brand-new intermediate transfer belt unit to the time when the intermediate transfer belt is set at the home position.

As shown in FIG. 11, sensors S1 and S2 change their output after clutch 309 is turned "ON", and clutch 309 is turned "OFF" when the intermediate transfer belt unit is set at the home position. In this case, it is understood that the period from when clutch 309 is turned "ON" to the time when the output from sensor Si transitions from "ON" to "OFF" is longer than predetermined time T (900 ms).

Figure 12:
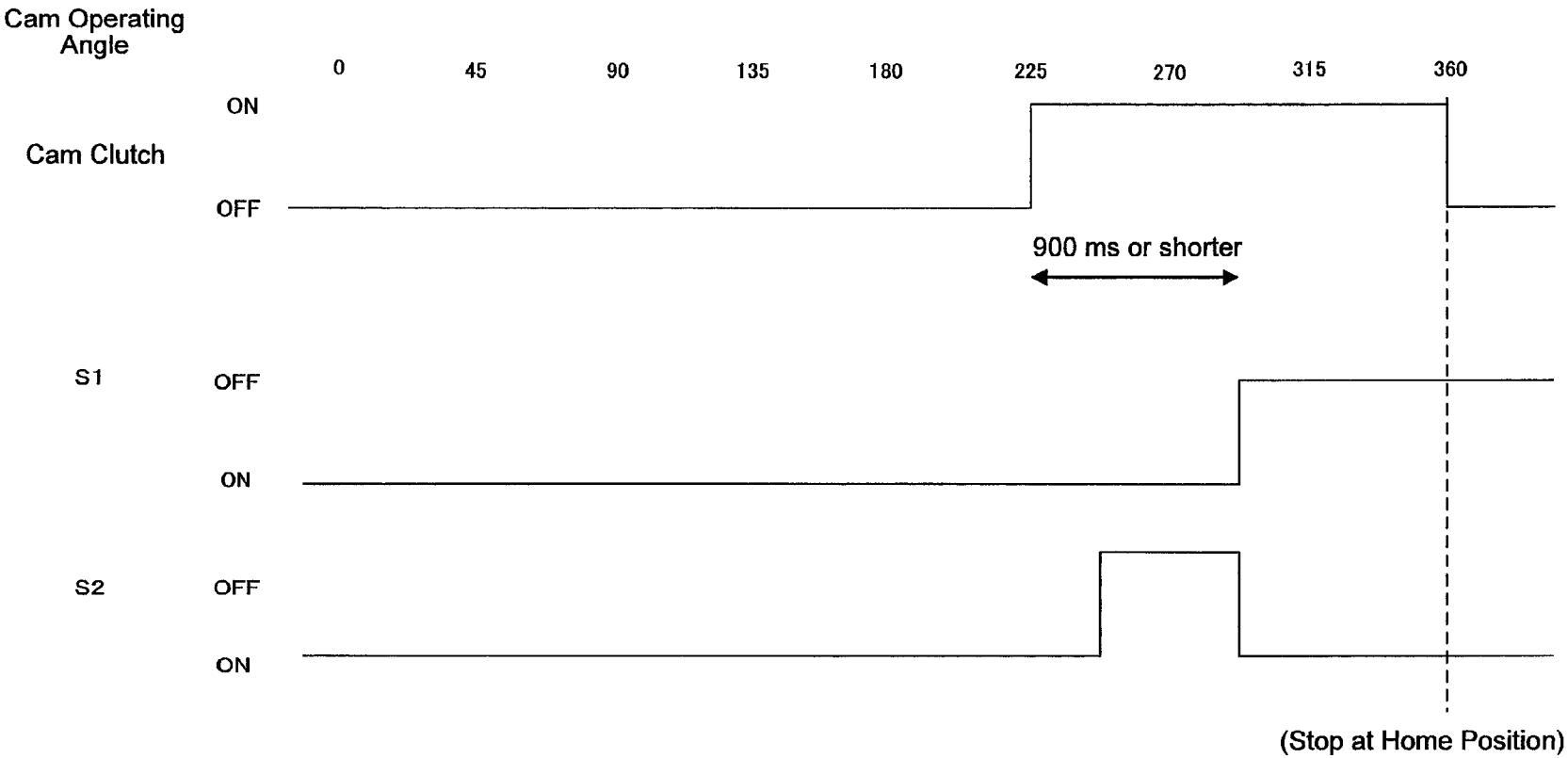
FIG. 12 is a time chart showing the output states of sensors S1 and S2 from when the apparatus is restarted in monochrome mode to the time when the apparatus is initialized to the home position.

FIG. 12 is a time chart showing the evolution of the output states of sensors S1 and S2 from when the apparatus is restarted in monochrome mode after the main apparatus being turned off during printing, to the time when the intermediate transfer belt is set to the home position.

As shown in FIG. 12, sensors S1 and S2 change their output after clutch 309 is turned "ON", and clutch 309 is turned "OFF" when the intermediate transfer belt unit is set at the home position. In this case, the period from when clutch 309 is turned "ON" to the time when the output from sensor S1 transitions from "ON" to "OFF" is shorter than predetermined time T (900 ms) shown in FIG. 11.

Description of Exemplary Embodiment 2

Figure 13:
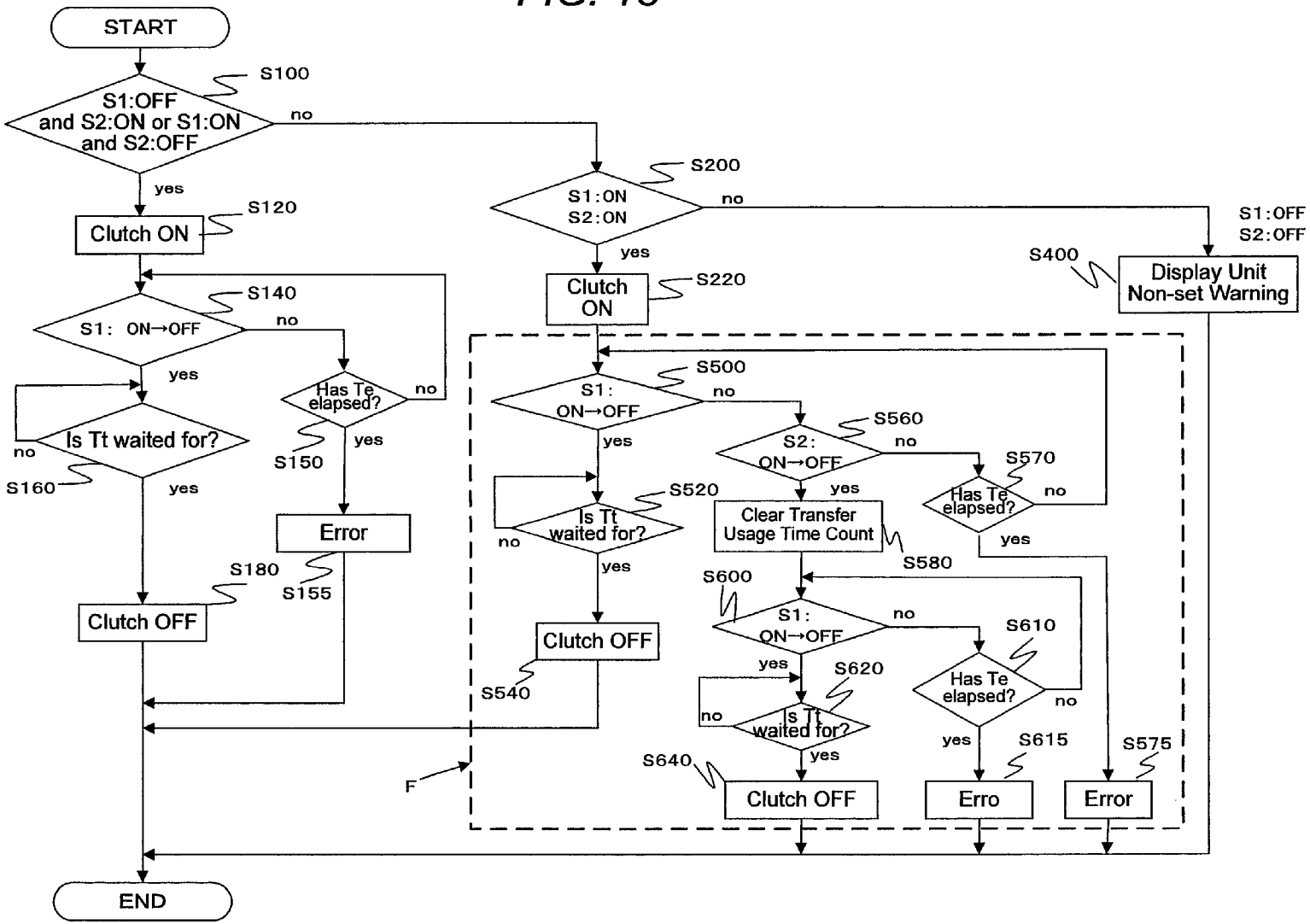
FIG. 13 is a flow chart showing an exemplary embodiment 2 of the process of determining whether a transfer belt unit is new or used and the presence/absence of a transfer belt unit; and, FIG. 14 is a time chart for illustrating the flow in exemplary embodiment 2 for the process of determining whether a transfer belt unit is new or used and the presence/absence of a transfer belt unit, FIG. 14A showing the case for a transfer belt unit that has been already used, and FIG. 14B showing the case for a brand-new transfer belt unit.

FIG. 13 is a flow chart showing an exemplary embodiment 2 of the process of determining whether a transfer belt unit is new or used and the presence/absence of a transfer belt unit.

FIG. 13 for exemplary embodiment 2 is the same as the flow chart shown in FIG. 9 for the above exemplary embodiment 1 except that Steps S240 to S360 in FIG. 9 is replaced by the processing sequence enclosed by the broken line indicated by F. FIG. 14 is a time chart for illustrating the operation flow in exemplary embodiment 2 for the process of determining whether a transfer belt unit is new or used and the presence/absence of a transfer belt unit.

First, when both S1 and S2 are determined to be "ON" (the operational mode in this case is either the BK mode or the mode where the transfer belt unit is replaced by a new one, hence shading part 304 of projection extending member 303 is positioned occupying the space inside sensor S1) (Step S200; yes), clutch 309 is turned "ON" so as to start eccentric cams 202*a* and 202*b* to rotate (Step S220). In this case, the motor for driving the eccentric cams is rotated clockwise (or in the opposite direction to the direction M) so that the output from sensor S1 will change first in the case of BK mode and so that the output from sensor S2 will change first in the case of the mode where a brand-new transfer belt unit is set, as shown in FIGS. 5A to 5C and FIGS. 7A to 7D.

Now, the essential processing steps in the portion enclosed by the broken line designated by F will be described.

Figure 14A:
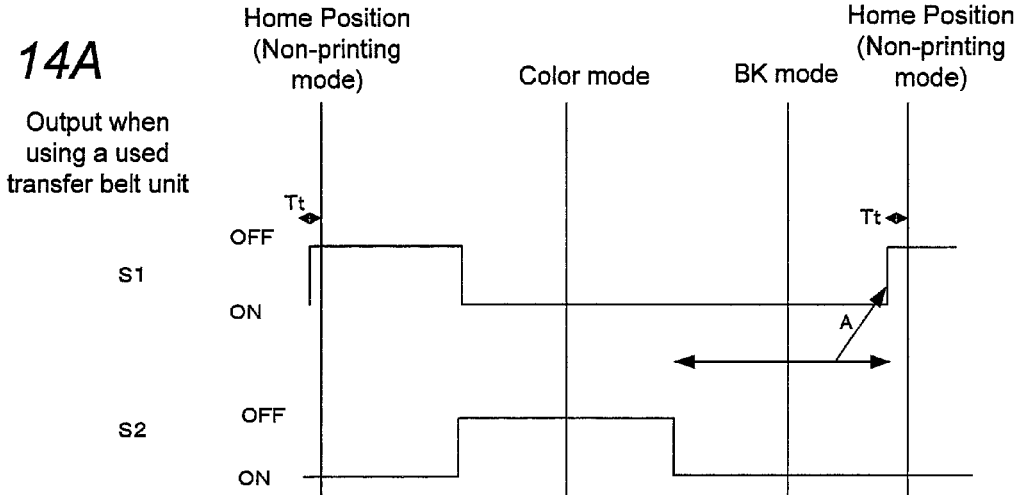

The sequence including steps S500, S520 and S540 corresponds to the process shown in FIG. 14A when the transfer belt unit is a used one. That is, the output of sensor S1 changing to "OFF" first (Step S500; yes) indicates that the state of the operational mode changes from the state in BK mode to the state in non-printing mode (arrow A), so that it is possible to indicate that the transfer belt unit is a used one.

Figure 14B:
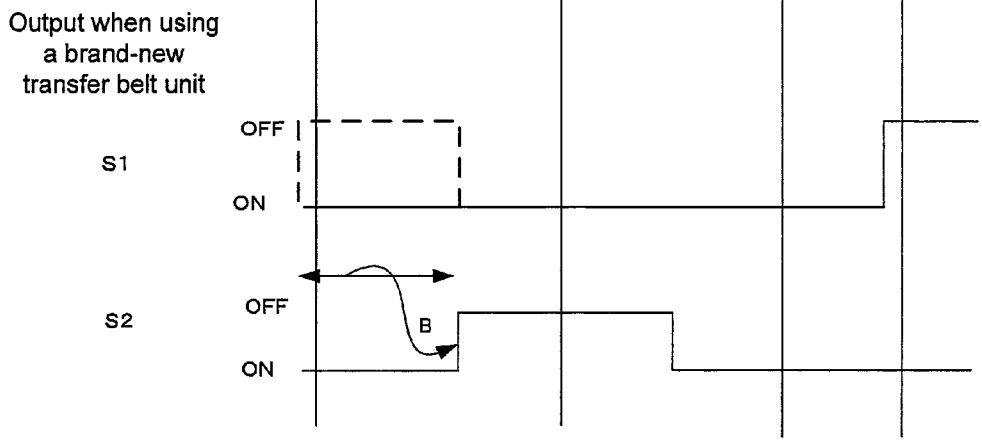

On the other hand, the sequence including steps S560, S580, S600, S620 and S640 corresponds to the process shown in FIG. 14B when the transfer belt unit is a new one. That is, the output of sensor S2 changing to "OFF" first (Step S560; yes) indicates that the state of the operational mode changes from the state in non-printing mode to the state in color mode (arrow B in FIG. 14B), so that it is possible to indicate that the transfer belt unit is a new one. Further, rotating the motor for driving the eccentric cams in the clockwise direction (in the opposite direction to the direction M) makes it possible to set the operational mode status into the non-printing mode state or initial state when the output from sensor S1 becomes "OFF" (Step S600). Accordingly, it is possible to initialize the contact/separation status between the intermediate transfer belt and the multiple photoreceptors. In this way, the operation of this process at timing when a normal activating sequence is performed, enables projection extending member 303 to move from its unused state position to its used state position without the need of executing a special sequence for replacement of an intermediate transfer belt unit.

It should be noted that the present invention is not limited to the above illustrated examples, but it goes without saying that various changes can be made therein without departing from the spirit and the scope of the present invention.

What is claimed is:

1. A transfer device comprising:

an intermediate transfer belt unit including an intermediate transfer belt for superposing toner images from a plurality of photoreceptors, one over another and a contacting/separating mechanism for putting the intermediate transfer belt into or out of contact with the plural photoreceptors; and, a detecting portion for performing detection of a contact/separation status between the photoreceptors and the intermediate transfer belt depending on the operational mode, inclusive of non-printing and printing modes and performing detection of the information for distinguishing a new intermediate transfer belt unit when the used intermediate transfer belt unit was replaced with a new unit, characterized in that the intermediate transfer belt unit includes a detection piece which makes the detecting portion detect the contact/separation status, and is changed in contact/separation status in accordance with the operational mode, by controlling and driving the contacting/separating mechanism, while the detecting portion includes: a sensor portion which detects the presence or absence of the detection piece based on the changing positional relationship of the detection piece as the contacting/separating mechanism moves; and a projection extending member which blocks light emitted from the sensor portion in order to detect whether the intermediate transfer belt unit was replaced with the new unit, wherein the projection extending member is arranged at a side of the detection piece when the intermediate transfer belt unit is the new unit while the projection extending member is rotatably pushed out by the detection piece when the intermediate transfer belt unit is in a used state, and based on the information detected by the sensor portion, gives notice of the contact/separation status between the photoreceptors and the intermediate transfer belt.

2. The transfer device according to claim 1, wherein the detecting portion detects the time of movement of the contacting/separating mechanism from when the contacting/separating mechanism starts to move until the projection extending member is moved in link with the positional change of the detection piece and pushed out by the detection piece, and compares the time of movement with a predetermined threshold time so as to determine whether the intermediate transfer belt unit is brand-new or not.

3. The transfer device according to claim 1, wherein, in order to distinguish operational modes inclusive of the non-printing and printing modes, the sensor portion of the detecting portion includes a first sensor part which detects the presence of the detection piece alone and a second sensor part which also detects the presence of the detection piece when the detection piece operates in link with the projection extending member, and on the condition that the output from the first sensor part and the output from the second sensor part exist in a particular output status, the detecting portion determines that the intermediate transfer belt is one that has been already used when the output from the first sensor part changes earlier than the output from the second sensor part, and that the intermediate transfer belt is a new one when the output from the second sensor part changes earlier than the output from the first sensor part, after the contacting/separating mechanism starts moving.

4. The transfer device according to claim 1, wherein when no detection piece is detected by the sensor portion and hence the contact/separation status of the intermediate transfer belt cannot be identified, the detecting portion determines that no intermediate transfer belt unit is mounted.

5. The transfer device according to claim 1, wherein the projection extending member of the detecting portion includes: a shading piece for blocking light; a support for rotatably supporting the shading part; and a weight disposed at the end where the shading piece is supported by the support, and is configured so that when the shading piece has rotated by a predetermined angle, the projection extending member is fixed at the predetermined positional angle by the force of gravity acting on the weight.

6. The transfer device according to claim 1, wherein the intermediate transfer belt unit drives and controls the contacting/separating mechanism during the start sequence including power activation so as to set the contact/separation status between the intermediate transfer belt and the plural photoreceptors into the initial state.

7. The transfer device according to claim 1, wherein the detecting portion distinguishes three modes of color mode, monochrome mode and non-printing mode, as the operational modes associated with the contact/separation status between the intermediate transfer belt and the photoreceptors.

8. An image forming apparatus characterized by inclusion of a transfer device according to claim 1.

* * * * *